US008586138B2

(12) United States Patent
Holderman et al.

(10) Patent No.: US 8,586,138 B2
(45) Date of Patent: Nov. 19, 2013

(54) METHOD OF COATING A POROUS SUBSTRATE WITH A THERMOPLASTIC MATERIAL FROM THE OUTSIDE OF THE SUBSTRATE

(75) Inventors: Luke W. Holderman, Carrollton, TX (US); Jacob R. Shoemate, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 205 days.

(21) Appl. No.: 13/009,021

(22) Filed: Jan. 19, 2011

(65) Prior Publication Data

US 2012/0183688 A1 Jul. 19, 2012

(51) Int. Cl.
*B05D 7/22* (2006.01)
*B05D 3/12* (2006.01)
*B05D 1/02* (2006.01)

(52) U.S. Cl.
USPC ..... 427/231; 427/233; 427/234; 427/236; 427/240; 427/243; 427/385.5; 427/425; 427/427.1; 427/427.3; 427/427.4; 427/427.5; 118/641; 118/52; 118/55; 118/302; 118/305; 118/320; 118/321; 118/323; 118/501

(58) Field of Classification Search
USPC ..... 427/231, 232, 233, 235, 236, 240, 243, 427/346, 385.5, 425, 427.1, 427.3, 427.4, 427/234, 427.5; 118/641, 52, 55, 56, 302, 118/305, 307, 318, 320, 321, 323, 326, 501
See application file for complete search history.

(56) References Cited

U.S. PATENT DOCUMENTS

| | | | | |
|---|---|---|---|---|
| 3,928,674 | A * | 12/1975 | Voermans | 427/171 |
| 6,136,374 | A * | 10/2000 | Reuscher | 427/233 |
| 6,182,833 | B1 | 2/2001 | Zittel | |
| 6,881,266 | B1 * | 4/2005 | Daykin et al. | 118/305 |
| 7,718,213 | B1 * | 5/2010 | Scheer | 427/2.24 |
| 2004/0185180 | A1 | 9/2004 | Seaver et al. | |
| 2007/0160768 | A1 * | 7/2007 | Ohnstad et al. | 427/421.1 |

FOREIGN PATENT DOCUMENTS

| | | | |
|---|---|---|---|
| JP | 07-227569 | A | 8/1995 |
| JP | 2009-247985 | A | 10/2009 |

* cited by examiner

*Primary Examiner* — Kirsten Jolley
(74) *Attorney, Agent, or Firm* — Paul Herman; Sheri Higgins Law; Sheri Higgins

(57) ABSTRACT

A method of coating a first porous substrate with a thermoplastic material comprises the steps of: rotating the substrate about an axis of the substrate; and applying the material in a liquefied state onto the substrate, wherein the step of applying is performed from the outside of the substrate. According to another embodiment, a method of coating a porous substrate with a thermoplastic material comprises the steps of: connecting a first porous substrate to a rotator; rotating the substrate about an axis of the substrate; pumping the material in a liquefied state from a receptacle to an application head; and applying the material in a liquefied state onto the substrate, wherein the step of applying is performed from the outside of the substrate. In certain embodiments, the material coated on the substrate is used to help remove at least a portion of a filtercake.

20 Claims, 4 Drawing Sheets

METHOD OF COATING A POROUS SUBSTRATE WITH A THERMOPLASTIC MATERIAL FROM THE OUTSIDE OF THE SUBSTRATE

TECHNICAL FIELD

A method of coating a first porous substrate with a thermoplastic material comprises the steps of: rotating the substrate about an axis of the substrate; and applying the material in a liquefied state onto the substrate, wherein the step of applying is performed from the outside of the substrate. In some embodiments, the method includes coating a second porous substrate with the thermoplastic material. The method of coating can include coating the substrate with a desired quantity of material per a given length of the substrate.

SUMMARY

According to an embodiment, a method of coating a first porous substrate with a thermoplastic material comprises the steps of: rotating the substrate about an axis of the substrate; and applying the material in a liquefied state onto the substrate, wherein the step of applying is performed from the outside of the substrate.

According to another embodiment, a method of coating a porous substrate with a thermoplastic material comprises the steps of: connecting a first porous substrate to a rotator; rotating the substrate about an axis of the substrate; pumping the material in a liquefied state from a receptacle to an application head; and applying the material in a liquefied state onto the substrate, wherein the step of applying is performed from the outside of the substrate.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
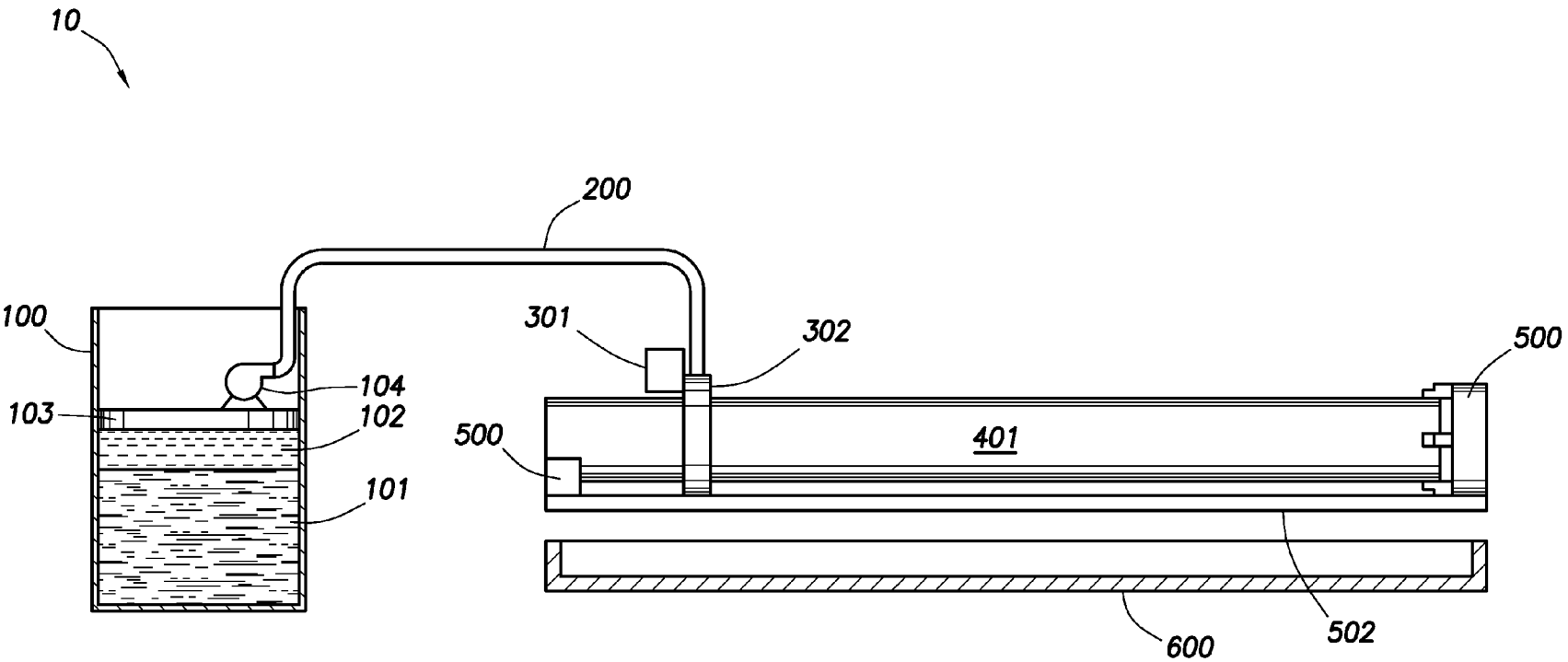
FIG. 1 is a diagram of an apparatus, according to certain embodiments, for coating a first porous substrate with a thermoplastic material.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more porous substrates, holding devices, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, water, or injection well. A well used to produce oil or gas is generally referred to as a production well. As used herein, a "well" includes at least one wellbore. A wellbore can include vertical, angled, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within about 100 feet of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore which can also contain a tubing string. A wellbore can contain an annulus. Examples of an annulus include, but are not limited to: the space between the wall of the wellbore and the outside of a tubing string in an open-hole wellbore; the space between the wall of the wellbore and the outside of a casing in a cased-hole wellbore; and the space between the inside of a casing and the outside of a tubing string in a cased-hole wellbore.

In unconsolidated or loosely consolidated subterranean formations (known as soft formations), fines, such as sediment and sand, can enter the tubing string during the production of oil or gas. When this occurs, several problems can arise, for example, erosion of production equipment, well plugging, decreased production of oil or gas, or production of the fines along with the oil or gas.

Sand control is often used in soft formations. Examples of sand control techniques include, but are not limited to, depositing a filtercake in a portion of the soft formation, using slotted liners and/or screens, and gravel packing.

In filtercake deposition, a fluid (such as a slurry), that commonly includes calcium carbonate and polymers, is introduced into the wellbore. The fluid flows into a desired portion of the subterranean formation. The ingredients in the fluid can form a permeable network, known as the filtercake, which binds fines, such as sand, together. After the filtercake has formed, oil or gas can be produced through the interconnected pores in the filtercake, but most of the fines will remain bound to the filtercake and not be produced along with the oil or gas.

It is often desirable to remove at least a portion of a filtercake at some stage in the production process. One common technique for removing a filtercake is to perform an acid wash. In an acid wash, a wash pipe is inserted into the wellbore. An acid is then flowed through the wash pipe and into the desired portion of the formation. The acid can come in contact with the filtercake. The acid can Chemically react with some of the ingredients in the filtercake, causing those ingredients to solubilize, and thus causing the filtercake to be removed from the subterranean formation.

Another sand control technique is using slotted liners and/or screens. A slotted liner can be a perforated pipe, such as a blank pipe. A screen usually contains holes that are smaller than the perforations in a slotted liner. The liner and/or screen can cause bridging of the fines against the liner or screen as oil or gas is being produced. Gravel packing is often performed in conjunction with the use of slotted liners and screens. Gravel is proppant having a particle-size class above sand, which is defined as having a largest dimension ranging from greater than 2 millimeters (mm) up to 64 mm. Gravel is commonly placed in a portion of an annulus between the wall of the wellbore and the outside of the screen. The gravel helps to trap fines from entering the production equipment or plugging the porous portions of the liner or screen.

Some of the problems associated with using a screen include, premature plugging of the holes in the screen and corrosion of the screen via contact with corrosive fluids in the well. In order to help protect a screen, the screen can be coated with a variety of materials. A thermoplastic material can be used to coat a porous substrate, such as a perforated pipe or a screen. As used herein, the term "thermoplastic" means a material that becomes liquid when heated, freezes to a solid, glassy substance when cooled sufficiently, and is capable of being remelted and remoulded. A thermoplastic material includes both crystalline regions and amorphous regions. The crystalline regions contribute to the material's strength and rigidity properties, while the amorphous regions contribute elastic properties. A thermoplastic material is elastic and flexible above the glass transition temperature that is specific for each type of material. The glass transition temperature is normally the midpoint in a temperature range for that material, which is in contrast to the melting point of a pure crystalline substance, such as water.

Because it is common for a section of a perforated pipe and a screen to be at least 30 feet long, it is difficult to coat the entire section of pipe or screen using a thermoplastic material. It is impossible, or difficult at best, to use prior coating methods to coat an entire section of pipe or screen in one application when the coating is a thermoplastic material. A novel method of coating a porous substrate with a thermoplastic material comprises application of the material from the outside of the porous substrate (i.e., from the outer diameter or outer perimeter of the porous substrate).

A method of coating a first porous substrate with a thermoplastic material comprises the steps of: rotating the substrate about an axis of the substrate; and applying the material in a liquefied state onto the substrate, wherein the step of applying is performed from the outside of the substrate. In another embodiment, a method of coating a porous substrate with a thermoplastic material comprises the steps of: connecting a first porous substrate to a rotator; rotating the substrate about an axis of the substrate; pumping the material in a liquefied state from a receptacle to an application head; and applying the material in a liquefied state onto the substrate, wherein the step of applying is performed from the outside of the substrate. Some of the advantages of the coated substrate include: the material coated on the substrate can help prevent premature plugging of the substrate due to fines migration; the material coated on the substrate can provide a chemical means by which to help dissolve at least a portion of a filtercake; and the coated substrate can provide a non-porous media. As used herein, the term "substrate" means an object having at least one surface to which a substance (e.g., a thermoplastic material) adheres. As used herein, the term "porous" means openings, such as holes or perforations, in a substrate that allow fluid to flow through.

Figure 2:
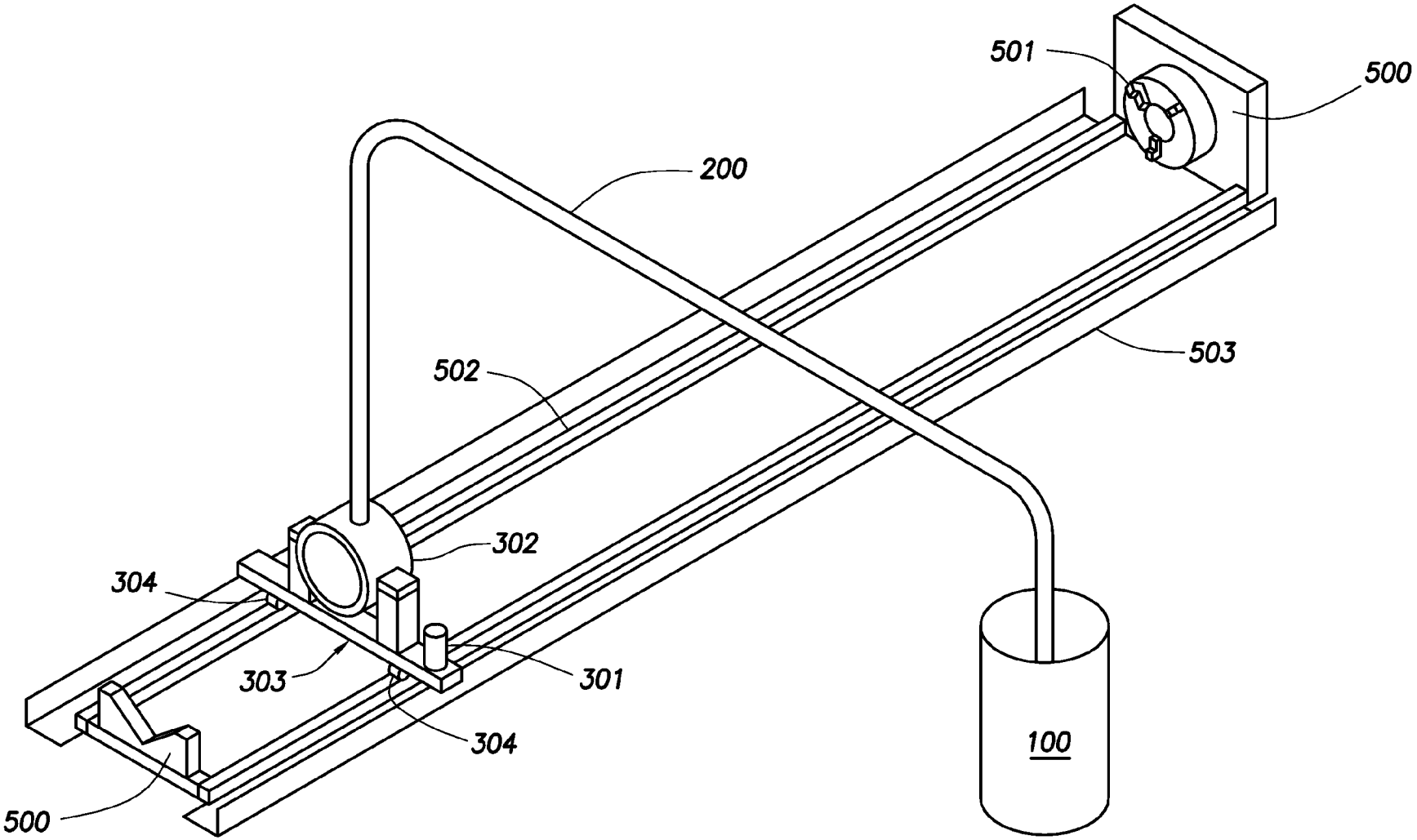
FIG. 2 is a diagram of some of the components of the apparatus according to other embodiments.

Turning to the Figures, FIG. 1 is a schematic of the apparatus 10 according to an embodiment for coating a porous substrate. FIG. 2 is a schematic of the apparatus 10 according to certain embodiments for coating the porous substrate. The method includes coating at least a first porous substrate with a thermoplastic material. The material is capable of being heated to a liquid state. The material is capable of being cooled to a solid state. The material is capable of being reheated from a solid state into a liquid state. According to an embodiment, the material is capable of removing at least a portion of a filtercake. For example, the material can remove the filtercake by dissolving some of the ingredients of the filtercake. Accordingly, the material can remove at least a portion of a filtercake by chemically reacting with at least some of the ingredients in the filtercake, thus causing those ingredients to solubilize. Preferably, the material is an acid. By way of example, if the material is an acid and is contacted with water, then some of the compounds in the material can dissociate and free up hydrogen ions. These hydrogen ions can then chemically react with at least some of the ingredients (e.g., calcium carbonate) in the filtercake, thus causing those ingredients to solubilize. According to an embodiment, the material is selected from the group consisting of polylactic acid, polyglycolic acid, and combinations thereof.

The method includes coating at least a first porous substrate. The method can further include coating a second porous substrate. The porous substrate can be any type of substrate that is capable of being coated with a thermoplastic material. It is to be understood that any reference to "the substrate" is meant to include a first substrate (singular), a second substrate (singular), or a first and second or more substrates (plural) without the need to continually refer to the substrate in both, the singular and plural forms.

Figure 3:
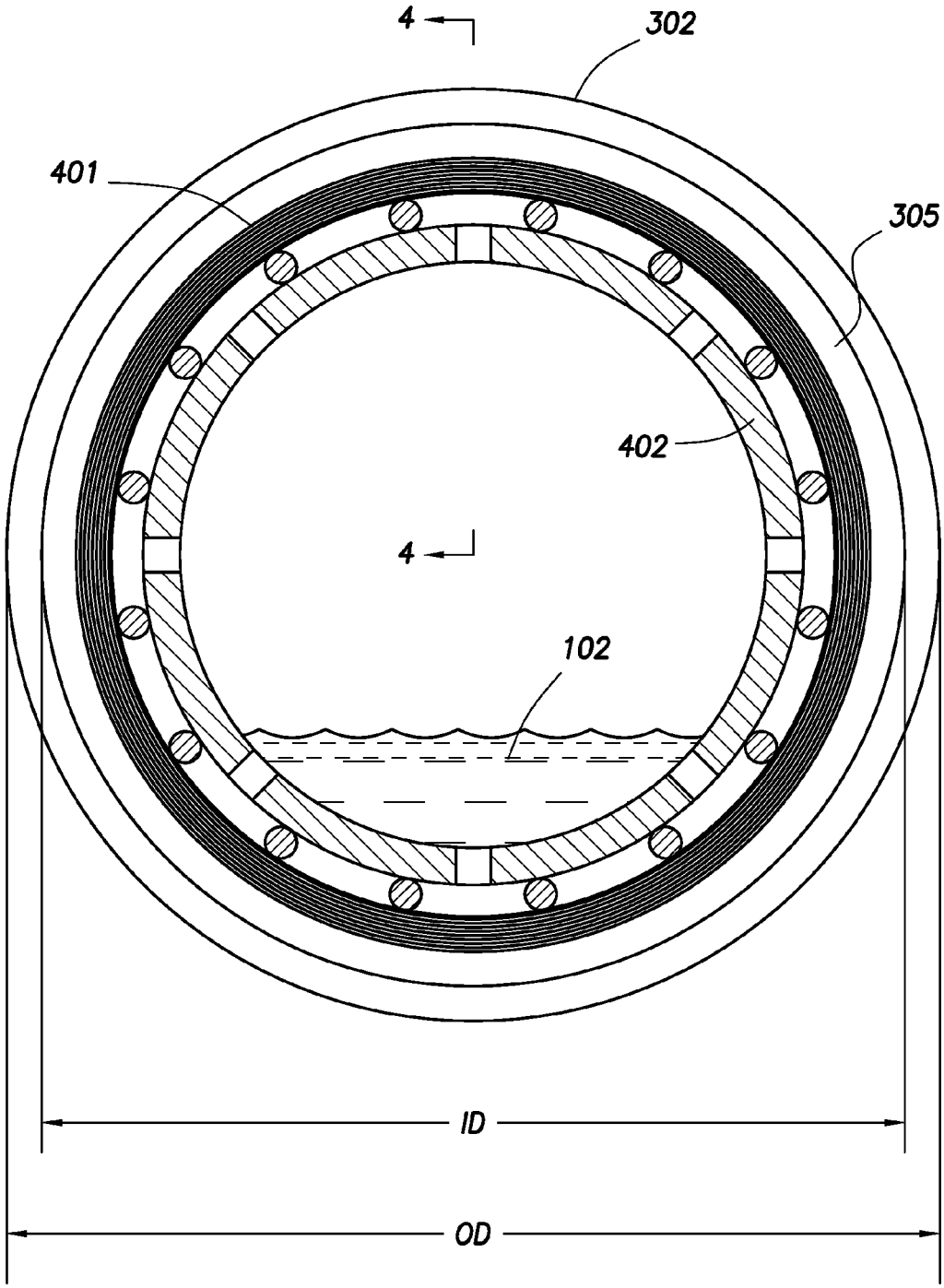
FIG. 3 is a cross-sectional view of a first and second porous substrate and an application head according to an embodiment.
Figure 4:
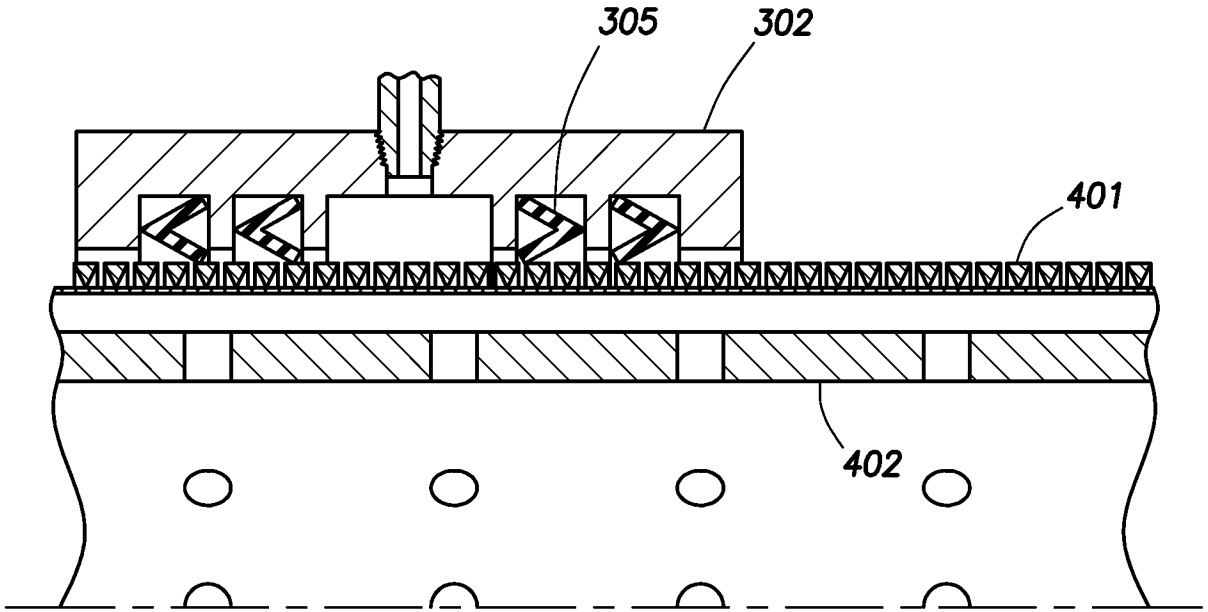
FIG. 4 is a plan view of FIG. 3 taken along line 4.

The substrate 401/402 is preferably hollow. In one embodiment, the substrate is tubular in shape. If the substrate is tubular in shape, then the substrate will have an outer diameter (O.D.) and an inner diameter (I.D.). According to another embodiment, the substrate is non-tubular in shape. Examples of non-tubular shapes include, but are not limited to, a square, a rectangle, and a triangle. If the substrate is non-tubular in shape, then the substrate will have an outer perimeter and an inner perimeter. An example of a first substrate 401 includes, but is not limited to, a screen. As depicted in FIG. 3, the first porous substrate 401 is a wire-wrap screen. An example of a second substrate 402 includes, but is not limited to, a pipe. The pipe can be perforated (causing the pipe to be porous) and the screen can contain holes (causing the screen to be porous). According to another embodiment, and as depicted in FIGS. 3 and 4, the second substrate 402 is positioned inside the first substrate 401. For example, the pipe can be positioned inside the screen. According to another embodiment, the second porous substrate can be attached to the first porous substrate. For example, and as depicted in FIG. 3, the second porous substrate 402 (e.g., a pipe) can be attached at its O.D. to the I.D. of the first porous substrate 401 (e.g., a screen). There can also be a space between the second porous substrate 402 and the first porous substrate 401, as depicted in FIG. 4.

The method can further include the step of connecting the substrate 401/402 to a rotator 501. The rotator 501 can be connected to a first holding device 500. The apparatus 10 can further include a second holding device 500. Preferably, the substrate 401/402 is connected at one end to the rotator 501, which is connected to the first holding device 500 and connected at the other end to the second holding device 500. According to another embodiment, the second holding device 500 further includes a rotator 501. In an embodiment, the rotator(s) 501 is capable of rotating the substrate. Preferably, the substrate 401/402 is capable of free rotation about its axis. For example, the substrate 401/402 can be connected to the rotator(s) 501 and/or the second holding device 500 such that neither the rotator nor the holding device impedes rotation of the substrate.

The method includes the step of rotating the substrate 401/402 about an axis of the substrate 401/402. The substrate can be rotated at a desired frequency. For example, the rotator 501 can be set to rotate at the desired frequency, such as a desired revolutions per minute (rpm's). The desired frequency can be selected based on a desired weight of the material to be coated on a given length of the substrate. For example, the desired frequency can be selected based on how many pounds of the material is to be coated on each foot of the substrate 401/402 (1 b/ft). The desired weight per length can vary.

The material can be held or stored in a receptacle 100. At room temperatures, the material is preferably in a solid state 101. The receptacle 100 can further comprise a receptacle heating element 103. The method can further include the step of heating at least a portion of the material in the receptacle 100 to a liquefied state 102. The receptacle heating element 103 is depicted in FIG. 1 as being positioned towards the top of the receptacle 100 and on top of the material; however, the element 103 can also be positioned at a location other than towards the top of the receptacle. For example, the element 103 can also be positioned at the bottom or towards the bottom of the receptacle 100. According to an embodiment, at least a portion of the material contained in the receptacle 100 is heated via the receptacle heating element 103. Preferably, the at least a portion of the material is heated to at least a temperature such that the material becomes a liquid 102.

The method can also include the step of pumping the thermoplastic material in a liquefied state 102 from the receptacle 100 to an application head 302. The step of pumping can occur after the step of heating at least a portion of the material in the receptacle 100 to a liquefied state 102. The apparatus 10 can comprise a pump 104. The pump 104 can be located adjacent to the receptacle heating element 103. Preferably, the pump 104 comprises a pump heating element (not shown). If the receptacle heating element 103 is located at a position other than at the top of the material (such as at the bottom of the receptacle 100), then the apparatus 100 can further include a pump tubing (not shown). The pump tubing can be positioned inside the receptacle. Accordingly, one end of the pump tubing can contact the liquefied material 102 contained in the receptacle 100 and the other end of the pump tubing can be connected to the pump 104. The method can further include the step of activating the pump 104 to pump the material in a liquefied state 102 from the receptacle 100 to the application head 302. According to an embodiment, when the pump is activated, the liquefied material 102 will travel through the pump tubing towards the pump.

The apparatus 10 can further include a feed tube 200. The feed tube 200 can be connected at one end to the pump 104 and connected at the other end to the application head 302. In this manner, the pump 104 can cause the liquefied material to move from the receptacle 100, through the feed tube 200, and into the application head 302. According to an embodiment, the pump has a variable flow rate. For example, the pump 104 can be used to control the flow rate of the material in a liquefied state 102 from the receptacle 100 to the application head 302. Preferably, the feed tube 200 is heated. By heating the feed tube 200, the material can be maintained in a liquefied state. The feed tube 200 is preferably heated to at least a minimum temperature such that the material is maintained in a liquefied state 102.

According to certain embodiments, the material is pumped into the application head 302. Preferably, the application head 302 further comprises an application head heating element (not shown). In this manner, the material can be maintained in a liquefied state. The temperature of the application head heating element is preferably variable. The temperature of the application head heating element can be set to a desired temperature. In a preferred embodiment, the desired temperature is at least a minimum temperature such that the material is maintained in a liquefied state.

According to an embodiment, the application head 302 is positioned relative to the outside of at least a portion of the substrate 401/402. In a preferred embodiment, the application head 302 completely surrounds the outside of at least a portion of the substrate 401/402 (shown in FIGS. 1 and 3). The application head 302 can further comprise a seal 305 (shown in FIGS. 3 and 4). The seal 305 can contact the O.D. of the first substrate 401. In this manner, the seal 305 can help apply the material onto the substrate 401/402.

The method includes the step of applying the material in a liquefied state onto the substrate, wherein the step of applying is performed from the outside of the substrate. Examples of applying include, but are not limited to, spraying the material onto the substrate, flowing the material onto the substrate, and injecting the material into the substrate. It should be understood that the step of applying can be performed in a variety of ways such that the material is maintained in a liquefied state 102 and can be applied from the outside of the substrate onto and/or into the substrate, and the preceding examples are not to be construed as the only ways of achieving such a result. When there is only a first porous substrate 401, the step of applying can comprise applying the liquefied material onto the O.D. of the first substrate through the porous portion of the first substrate and into the I.D. of the first substrate. When there is a first and second porous substrate 401 and 402, the step of applying can comprise applying the liquefied material onto the O.D. of the first substrate 401, through the porous portion of the first substrate, through the I.D. of the first substrate, and then onto the O.D. of the second substrate 402, through the porous portion of the second substrate, and into the I.D. of the second substrate. The step of applying can comprise injecting the material onto the O.D. and into the porous portions and the I.D. The step of applying can comprise forcing the material onto the O.D. and into the porous portions and the I.D. Preferably, the material is capable of adhering to a surface of the substrate 401/402. According to an embodiment, the material coats the O.D. and the I.D. of the substrate 401/402. According to this embodiment, it is preferred that the material fills the porous portions of the substrate. The material in a liquefied state, can coat the outside of the substrate, fill the porous portions of the substrate, and coat the inside of the substrate.

The method can further include the step of causing the application head 302 to travel axially along the length of the substrate 401/402. The apparatus 10 can also include a drive motor 301. The drive motor 301 can be connected in any manner that allows for movement of the application head 302. By way of example, the drive motor 301 can be connected directly to the application head 302. By way of another example, and as depicted in FIG. 2, the drive motor 301 can be connected to an application head platform 303. In this embodiment, the application head 302 can also be connected to the platform 303. The apparatus 10 can also include a first pair of guide rails 502 and optionally, a second pair of guide rails 503. The rails can help guide and support the application head 302 or the application head and the drive motor 302 and 301. Preferably, the platform 303 travels axially along the length of the substrate unimpeded. The platform 303 can further include a mobilizer, a pair, or more than one pair of mobilizers 304. The mobilizer 304 can be any device that allows or assists the platform 303, and the application head 302, or the application head and drive motor 302 and 301, to travel along the guide rails 502/503. An example of a mobilizer includes, but is not limited to, a wheel 304. According to certain embodiments, the drive motor 301 and the application head 302 travel axially along the length of the substrate. According to other embodiments, the drive motor 301, the application head 302, and the platform 303 travel axially along the length of the substrate.

The distance that the application head 302 (and any other components) travels axially along the substrate 401/402 can be controlled. According to an embodiment, the application head 302 (and any other components) travels axially along the length of the substrate 401/402 for a desired distance. Preferably, the length of the feed tube 200 is such that it allows the application head 302 (and any other components) to travel axially along the length of the substrate 401/402 for the desired distance. In one embodiment, the desired distance is at least 90% of the total length of the substrate 401/402. According to another embodiment, the desired distance is the entire length of the substrate 401/402.

The step of applying can further include coating the substrate 401/402 with a desired quantity of the material per a given length of the substrate. For example, the substrate can be coated with a desired pounds of material per foot of substrate (lbs/ft). One of the advantages of the material is that it can be used to help remove a portion of filtercake. When the material is to be used for removing a portion of a filtercake, then the desired quantity of coated material can be determined based on the concentration of certain ingredients in the filtercake (e.g., the concentration of calcium carbonate). By way of example, the desired quantity can be determined based on the amount of available acid from the material capable of dissolving at least a portion of a filtercake containing a given concentration of calcium carbonate. In order to achieve the desired quantity of coating, it may be necessary to apply excess material in a liquefied state 102 onto the substrate 401/402 because some of the material being applied onto the substrate may not adhere to the substrate. The desired quantity can be achieved by at least regulating the flow rate of the fluid out of the application head or regulating the speed at which the application head travels along the length of the substrate. The substrate 401/402 can be coated a second time to achieve the desired quantity. There may be other ways of achieving the desired quantity, and the preceding examples are not meant to be construed as the only ways of achieving such a result.

The method includes the step of rotating the substrate 401/402 about an axis of the substrate 401/402. The substrate 401/402 can be rotated for a desired period of time. According to an embodiment, the desired period of time is at least how long it takes for the application head 302 to travel the desired distance along the length of the substrate 401/402. According to another embodiment, the desired period of time is at least 10 minutes after the application head 302 has traveled the desired distance along the length of the substrate 401/402. According to yet another embodiment, the desired period of time is the time it takes for the material to become a solid on the substrate after the step of applying. According to certain embodiments, because the substrate 401/402 is being rotated at least for the time that the material is being applied onto the substrate 401/402, the material in a liquefied state is inhibited from collecting or pooling on at least a portion of the I.D. of the substrate 401/402. Referring to FIG. 3, without the rotation of the substrate 401/402, the material in a liquefied state 102, can collect or pool at the bottom of the substrate 401/402. Moreover, by rotating the substrate 401/402 during the step of applying, the material can flow from the I.D. of the substrate back through the porous portions of the substrate and onto the O.D. of the substrate, providing a better coating on the substrate. The method can further comprise the step of cooling the material or allowing the material to cool to a solid state after the step of applying.

The apparatus 10 can further include a collector 600. The collector 600 can collect any excess material that does not adhere to the substrate 401/402.

The coated substrate can be used for a variety of applications. One example of such an application is the oil and gas industry. In an embodiment, the method can further include the step of placing the coated substrate 401/402 in at least a portion of a subterranean formation after the step of applying. If the method includes the step of cooling or allowing to cool, then the step of placing can occur after the step of cooling or allowing to cool. According to this embodiment, the method can also include the step of contacting the substrate 401/402 with a liquid, such as water, to cause at least a portion of the material to remove at least a portion of a filtercake.

In some applications, it would be desirable to remove the material or allow the material to be removed from the substrate 401/402 after a certain length of time. For example, in the case where the coated substrates include a perforated pipe and a screen, and the substrates are used in a wellbore, it may be desirable to remove the material or allow the material to be removed from the substrates after a desired period of time (such as for production of oil or gas from the subterranean formation). Preferably, the material is capable of being removed from the substrate at a predetermined length of time. Examples of removing or allowing the material to be removed include, but are not limited to: allowing the coated material to come in contact with at least a minimum temperature high enough to heat the material to a liquefied state; contacting the material with a heat source (e.g., a heated liquid or a heated gas) such that the material becomes a liquid; allowing the material to come in contact with a compound that at least partially solubilizes the material; and contacting the material with a compound that at least partially solubilizes the material.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of coating a first porous substrate with a thermoplastic material comprising the steps of:

rotating the substrate about an axis of the substrate, wherein the substrate is a pipe or a screen, and wherein the substrate is part of a sand control assembly; and applying the material in a liquefied state onto the substrate, wherein the step of applying is performed from the outside of the substrate, and wherein the step of applying comprises applying the liquefied material from the outer diameter of the substrate through the porous portion of the substrate and into the inner diameter of the substrate.

2. The method according to claim 1, wherein the material is selected from the group consisting of polylactic acid, polyglycolic acid, and combinations thereof.

3. The method according to claim 1, further comprising coating a second porous substrate.

4. The method according to claim 3, wherein the first substrate and the second substrate are hollow.

5. The method according to claim 1, further comprising the step of connecting the substrate to a rotator.

6. The method according to claim 1, wherein the substrate is rotated at a desired frequency.

7. The method according to claim 1, further comprising an application head.

8. The method according to claim 7, wherein the application head further comprises an application head heating element.

9. The method according to claim 7, wherein the application head is positioned relative to the outside of at least a portion of the substrate.

10. The method according to claim 9, wherein the application head completely surrounds the outside of at least a portion of the substrate.

11. The method according to claim 7, further comprising the step of pumping the material in a liquefied state from a receptacle to the application head.

12. The method according to claim 11, wherein the receptacle further comprises a receptacle heating element.

13. The method according to claim 7, further comprising the step of causing the application head to travel axially along the length of the substrate during the step of applying.

14. The method according to claim 13, wherein the application head travels axially along the length of the substrate for a desired distance.

15. The method according to claim 1, wherein the substrate is rotated for a desired period of time.

16. The method according to claim 15, wherein the desired period of time is the time it takes for the material to become a solid on the substrate.

17. A method of coating a first porous substrate with a thermoplastic material comprising the steps of:

rotating the substrate about an axis of the substrate, wherein the substrate is a pipe or screen, and wherein the substrate is part of a sand control assembly; and applying the material in a liquefied state onto the substrate, wherein the step of applying is performed from the outside of the substrate, wherein the material coats the outside of the substrate, fills the porous portion of the substrate, and coats the inside of the substrate during the step of applying.

18. The method according to claim 17, wherein the step of applying further comprises coating the substrate with a desired quantity of the material per a given length of the substrate.

19. A method of coating a porous substrate with a thermoplastic material comprising the steps of:

connecting a first porous substrate to a rotator, wherein the substrate is a pipe or a screen, and wherein the substrate is part of a sand control assembly;

rotating the substrate about an axis of the substrate;

pumping the material in a liquefied state from a receptacle to an application head; and applying the material in a liquefied state onto the substrate, wherein the step of applying is performed from the outside of the substrate, and wherein the inside of the substrate is fully or partially coated with the material during the step of applying.

20. The method according to claim 19, wherein the substrate has an outer diameter and an inner diameter.

* * * * *